US008826885B2

(12) United States Patent
Asada et al.

(10) Patent No.: US 8,826,885 B2
(45) Date of Patent: Sep. 9, 2014

(54) FUEL INJECTION CONTROL SYSTEM

(75) Inventors: Yukihiro Asada, Wako (JP); Kenichi Machida, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 570 days.

(21) Appl. No.: 13/180,679

(22) Filed: Jul. 12, 2011

(65) Prior Publication Data

US 2012/0016569 A1 Jan. 19, 2012

(30) Foreign Application Priority Data

Jul. 14, 2010 (JP) ..... 2010-159710

(51) Int. Cl.
*F02D 41/10* (2006.01)
*F02D 41/04* (2006.01)
*F02D 11/10* (2006.01)

(52) U.S. Cl.
CPC ..... *F02D 11/106* (2013.01); *F02D 41/10* (2013.01); *F02D 41/045* (2013.01)
USPC ..... 123/399; 701/103; 701/104

(58) Field of Classification Search
CPC ..... F02D 41/045; F02D 41/182; F02D 41/10; F02D 41/408; F02D 11/10; F02D 11/105; F02D 11/106; F02D 2011/102; F02D 11/107; F02D 2200/0404; F02D 41/0002
USPC ..... 123/102, 103, 104, 106, 110, 115, 399, 123/492
See application file for complete search history.

(56) References Cited

U.S. PATENT DOCUMENTS

| | | | | | |
|---|---|---|---|---|---|
| 4,771,752 | A | * | 9/1988 | Nishimura et al. | 123/399 |
| 4,903,671 | A | * | 2/1990 | Araki et al. | 123/682 |
| 4,953,530 | A | * | 9/1990 | Manaka et al. | 123/399 |
| 4,962,570 | A | * | 10/1990 | Hosaka et al. | 123/399 |
| 4,964,051 | A | * | 10/1990 | Sekozawa et al. | 701/102 |
| 4,984,552 | A | * | 1/1991 | Nishizawa et al. | 123/492 |
| 5,078,109 | A | * | 1/1992 | Yoshida et al. | 123/350 |
| 5,095,874 | A | * | 3/1992 | Schnaibel et al. | 123/361 |
| 5,099,429 | A | * | 3/1992 | Onari et al. | 701/103 |
| 5,255,655 | A | * | 10/1993 | Denz et al. | 123/479 |
| 5,277,164 | A | * | 1/1994 | Takahashi et al. | 123/492 |
| 5,349,933 | A | * | 9/1994 | Hasegawa et al. | 123/486 |

(Continued)

FOREIGN PATENT DOCUMENTS

| | | |
|---|---|---|
| JP | 63-201802 | 8/1988 |
| JP | 07-166931 | 6/1995 |
| JP | 10-9012 | 1/1998 |
| JP | 2002-106405 | 4/2002 |

*Primary Examiner* — Thomas Moulis
(74) *Attorney, Agent, or Firm* — Rankin, Hill & Clark LLP

(57) ABSTRACT

A fuel injection control system provided with a throttle by wire (TBW) system detecting an operation condition of a throttle grip and controlling, via an actuator, a throttle valve. The control system detects the throttle valve opening and controls an injector. An increased quantity correction value is determined based upon of an output of a throttle valve opening sensor and an operation condition of the throttle grip. When an acceleration condition of a vehicle is detected according to the output of the throttle valve opening sensor, an increased quantity correction of fuel is performed. The increased quantity correction value is brought to an attenuation condition in which the increased quantity correction value is gradually decreased, or a stop condition in which the increased quantity correction value is made to zero, when the throttle grip is not in drive in an opening direction, even though an acceleration condition is detected.

18 Claims, 13 Drawing Sheets

(56) References Cited

U.S. PATENT DOCUMENTS

| | | | | |
|---|---|---|---|---|
| 5,353,768 | A * | 10/1994 | Messih et al. | 123/491 |
| 5,465,700 | A * | 11/1995 | Nishimoto | 123/492 |
| 5,522,366 | A * | 6/1996 | Konno et al. | 123/492 |
| 6,199,537 | B1 * | 3/2001 | Kowatari et al. | 123/399 |
| 7,549,407 | B2 * | 6/2009 | Krupadanam | 123/399 |
| 8,060,293 | B2 * | 11/2011 | Meyer et al. | 701/104 |
| 2002/0129790 | A1 * | 9/2002 | Kowatari et al. | 123/399 |
| 2003/0075147 | A1 * | 4/2003 | Kowatari et al. | 123/399 |
| 2009/0178647 | A1 * | 7/2009 | Wang | 123/399 |
| 2012/0323467 | A1 * | 12/2012 | Okoshi et al. | 701/104 |

* cited by examiner

FIG. 5

| OPERATION CONDITION OF TH VALVE | OPERATION CONDITION OF TH GRIP | REQUIREMENT JUDGMENT BY TARGET TH VALVE OPENING | ACCELERATION CORRECTION CONDITION |
|---|---|---|---|
| TH VALVE IS IN DRIVE IN AN OPENING DIRECTION | TH GRIP IS IN AN OPENING DIRECTION (TH GRIP CONDITION=2) | TARGET TH VALVE OPENING ≥ MAINTENANCE JUDGMENT VALUE | MAINTENANCE...(1) |
| | | TARGET TH VALVE OPENING < MAINTENANCE JUDGMENT VALUE | CONTINUATION...(2) |
| | TH GRIP IS IN STOP (TH GRIP CONDITION=1) | NO | ATTENUATION...(3) |
| | TH GRIP IS IN A CLOSING DIRECTION OR IS FULLY CLOSED (TH GRIP CONDITION=0) | NO | STOP...(4) |
| TH VALVE IS IN STOP OR TH VALVE IS IN DRIVE IN A CLOSING DIRECTION | TH GRIP IS IN AN OPENING DIRECTION (TH GRIP CONDITION=2) | NO | MAINTENANCE...(5) |
| | TH GRIP IS IN STOP (TH GRIP CONDITION=1) | NO | ATTENUATION...(6) |
| | TH GRIP IS IN A CLOSING DIRECTION OR IS FULLY CLOSED (TH GRIP CONDITION=0) | NO | STOP...(7) |

FUEL INJECTION CONTROL SYSTEM

BACKGROUND OF THE INVENTION

1. Field of the Invention

The present invention generally relates to a fuel injection control system and, in particular, to a fuel injection control system having a throttle device in which a throttle valve is driven by an actuator.

2. Description of Related Art

There is known a fuel injection control system for an internal combustion engine in which acceleration and deceleration conditions of a vehicle are detected by various sensors in order to perform fuel injection according to a travel condition of the vehicle. However, over-shoots or under-shoots may be produced in outputs of such sensors due to various factors, so that it is difficult to make a judgment on the acceleration and deceleration conditions of the vehicle.

Japanese Patent No. 2849322 discloses a fuel injection control system adapted to judge acceleration and deceleration conditions of a vehicle based upon an output of a pressure sensor provided in an intake pipe of an internal combustion engine. The JP '322 system is adapted to change basic values to judge the acceleration and deceleration conditions at the end of accelerating and decelerating. The JP '322 arrangement is intended to prevent a judgment of the deceleration condition due to an over-shoot of a pressure sensor value when accelerating by quickly open-operating a throttle device to a fixed opening. Similarly, the JP '322 arrangement prevents a judgment of the acceleration condition due to an under-shoot of the pressure sensor value when decelerating by quickly bringing the throttle device to a fully closed condition.

In a TBW (throttle-by-wire) system that drives a throttle valve by an actuator such as an electric motor, etc., according to operation of a throttle device (throttle grip, throttle pedal, etc.) by an operator, there is a possibility that a real throttle valve opening (hereinafter referred to as a real TH valve opening) will over-shoot and under-shoot relative to a target opening of the throttle valve (hereinafter referred to as a target TH valve opening) due to mechanical characteristics such as gears, springs, etc. which are contained in the actuator and the throttle device.

Concretely, there is a possibility that, at the time of acceleration-operating, such as quickly open-operating of the throttle device and maintaining the opening of the throttle valve, the real TH valve opening once over-shoots relative to the target TH valve opening and then under-shoots. At this time, in a system that judges the acceleration and deceleration conditions of a vehicle according to the real TH valve opening and controls a fuel injection quantity, there is a possibility that, though the throttle device is maintained at a fixed opening, it is judged that the vehicle is in the accelerated or decelerated condition, and the fuel injection quantity is decreased and increased. As such, the engine operation and riding experience may not match the desires of the operator, as evidenced by the condition of the throttle device.

In the related art disclosed in the aforementioned JP '322 patent, over-shoot and under-shoot of the real TH valve opening relative to the target TH valve opening due to mechanical characteristics is not taken into consideration. Therefore, there may result conditions, as mentioned hereinbefore, in which the engine operation and riding experience do not correspond to the throttle setting input by the user via the throttle device.

SUMMARY OF THE INVENTION

The present invention provides a fuel injection control system that overcomes the problem of the above mentioned related art and can appropriately control a fuel injection quantity at the time of acceleration, even when a real opening of a throttle valve driven by an actuator over-shoots and/or under-shoots relative to a target throttle valve opening.

The present invention includes a fuel injection control system for a vehicle that is provided with a (throttle-by-wire) TBW system detecting an operation condition of throttle operator and controls, via an actuator, a throttle valve provided in an intake system of an engine. The fuel injection control system is adapted to detect an opening of the throttle valve and determine a fuel injection quantity. The fuel injection control system includes: throttle operation condition detector that serves to detect the operation condition of the throttle operator; throttle valve opening detector that serves to detect the opening of the throttle valve; and fuel injection quantity controller that serves to control fuel injection of a fuel injection valve provided at the engine. The fuel injection quantity control controller determines an increased quantity correction value based upon an output of the throttle valve opening detector and the operating condition of the throttle operator. When the fuel injection quantity controller detects an acceleration condition of the vehicle according to the output of the throttle valve opening detector, the fuel injection quantity controller performs correction of an increase in quantity of fuel. Accordingly, in the throttle device to which the TBW system is applied, even if an over-shoot and an under-shoot are produced in a real throttle valve opening relative to a target throttle valve opening, the fuel injection quantity for acceleration correction is set while taking the operation condition of the throttle operator (throttle grip and the like) at that time into consideration. Therefore, correction of the fuel injection quantity according to open-operation of the throttle operator by the driver is made possible. Although over-shoots and under-shoots are produced, the feeling of the engine is not unmatched with respect to the throttle operation by the driver, and good fuel injection correction can be performed.

In further accordance with the present invention, the fuel injection quantity controller is set to cause the increased quantity correction value to be brought to either an attenuation condition, in which the increased quantity correction value is gradually attenuated, or a stop condition, in which the increased quantity correction value is made to be zero, when the acceleration condition of the vehicle is detected and the operation condition of the throttle operator is not in drive in an opening direction. Therefore, even if the acceleration judgment based on the real throttle valve opening is made as an "acceleration condition" by rising of the real throttle valve opening relative to the target throttle valve opening after the under-shoot, the fuel injection quantity is not increased, and appropriate fuel injection control corresponding to the operation condition of the throttle operator can be performed.

In further accordance with the present invention, the fuel injection quantity controller is set so as to cause the increased quantity correction value to be brought to a maintenance condition in which the increased quantity correction value is maintained unchanged when the acceleration condition of the vehicle is not detected and the operation condition of the throttle operator is in drive in the opening direction. Therefore, even if the acceleration judgment based on the real throttle valve opening is made as a "non acceleration condition" by lowering of the real throttle valve opening relative to the target throttle valve opening after the over-shoot, the fuel injection quantity is not brought to the attenuation condition and the stop condition, and appropriate fuel injection control corresponding to the operation condition of the throttle operator can be performed.

In further accordance with the present invention, the fuel injection quantity controller is set so as to derive a target throttle valve opening of the throttle valve based upon a revolution number (speed) of the engine and a gear position of a transmission, compare the target throttle valve opening to a fixed maintenance judgment value when the acceleration condition of the vehicle is detected and the operation condition of the throttle operator is in drive in the opening direction, and bring a renewal process of the increased quantity correction value corresponding to an output of the throttle valve opening detector to a continuation condition in which the renewal process is continued if the target throttle valve opening is smaller than the maintenance judgment value. Therefore, when the acceleration judgment based on the throttle valve opening is made as an "acceleration condition" and the throttle operator is in drive in the opening direction, it can be judged whether the renewal process of the acceleration correction value is performed by comparing the target throttle opening and the fixed maintenance judgment value.

In accordance with another aspect of the invention, if the target throttle valve opening is not less than the maintenance judgment value, the increased quantity correction value corresponding to the output of the throttle valve opening detector is set so as to be brought to a maintenance condition in which the increased quantity correction value is maintained without change. Therefore, when the acceleration judgment based on the throttle valve opening is made as an acceleration condition and the throttle operator is in drive in the opening direction, it can be judged whether the renewal process of the acceleration correction value is continued or is brought to the maintenance condition by comparing the target throttle opening and the fixed maintenance judgment value. Thereby, it is possible to more finely set the increased quantity correction value at the time of acceleration.

In further accordance with the present invention, the fuel injection quantity controller judges the operation condition of the throttle operator based upon an opening change amount (ΔTHG) of the throttle operator. The fuel injection quantity controller judges that the operation of the throttle operator is in the opening direction when the opening change amount (ΔTHG) is greater than a fixed opening side threshold value (ΔTHGO), judges that the operation condition of the throttle operator is in stop when the opening change amount (ΔTHG) is less than the fixed opening side threshold value (ΔTHGO) and is not less than a fixed closing side threshold value (ΔTHGC), and judges that the operation condition of the throttle operator is in a closing direction or is fully closed when the opening change amount (ΔTHG) is less than the fixed closing side threshold value (ΔTHGC). The fuel injection quantity controller brings the increased quantity correction value to an attenuation condition in which the increased quantity correction value is gradually decreased when the operation condition of the throttle operation operator is in stop and, on the other hand, brings the increased quantity correction value to a stop condition in which the increased quantity correction amount is made to zero if it is judged that the operation condition of the throttle operator is in the closing direction or is fully closed. Therefore, the operation condition of the throttle operator is easily judged and it is possible to set an appropriate increased quantity correction value according to this operation condition.

According to a further aspect of the present invention, the increased quantity correction amount is decreased by using a first stage attenuation degree in the attenuation condition and, if the increased quantity correction amount becomes a fixed value, the increased quantity correction amount is decreased until it becomes zero by using a second stage attenuation degree. By using first and second stage attenuation degrees, an attenuation process of the acceleration increased quantity value can be smoothly performed.

In further accordance with the present invention, if a throttle valve opening change amount (ΔTH) that is detected by the throttle valve opening detector is not less than a fixed value, the fuel injection quantity controller brings the renewal process of the increased quantity correction value corresponding to the output of the throttle valve opening detector to a continuation condition in which the renewal process is continued. As such, even if the throttle valve is in the opening direction, the renewal of the acceleration correction value can be set so as not to be performed unless the opening change amount exceeds the fixed value.

In accordance with another aspect of the invention, the maintenance judgment value is derived from a data map previously defined according to a gear stage number of the transmission and the revolution number (speed) of the engine. Accordingly, it is easy to finely set the maintenance judgment value according to the gear stage number and the engine revolution number (speed).

BRIEF DESCRIPTION OF THE DRAWINGS

FIG. 5 is a list showing a relationship between an operation condition of a TH valve and an operation condition of a TH grip, and an acceleration correction condition.

DETAILED DESCRIPTION OF THE PREFERRED EMBODIMENTS

Figure 1:
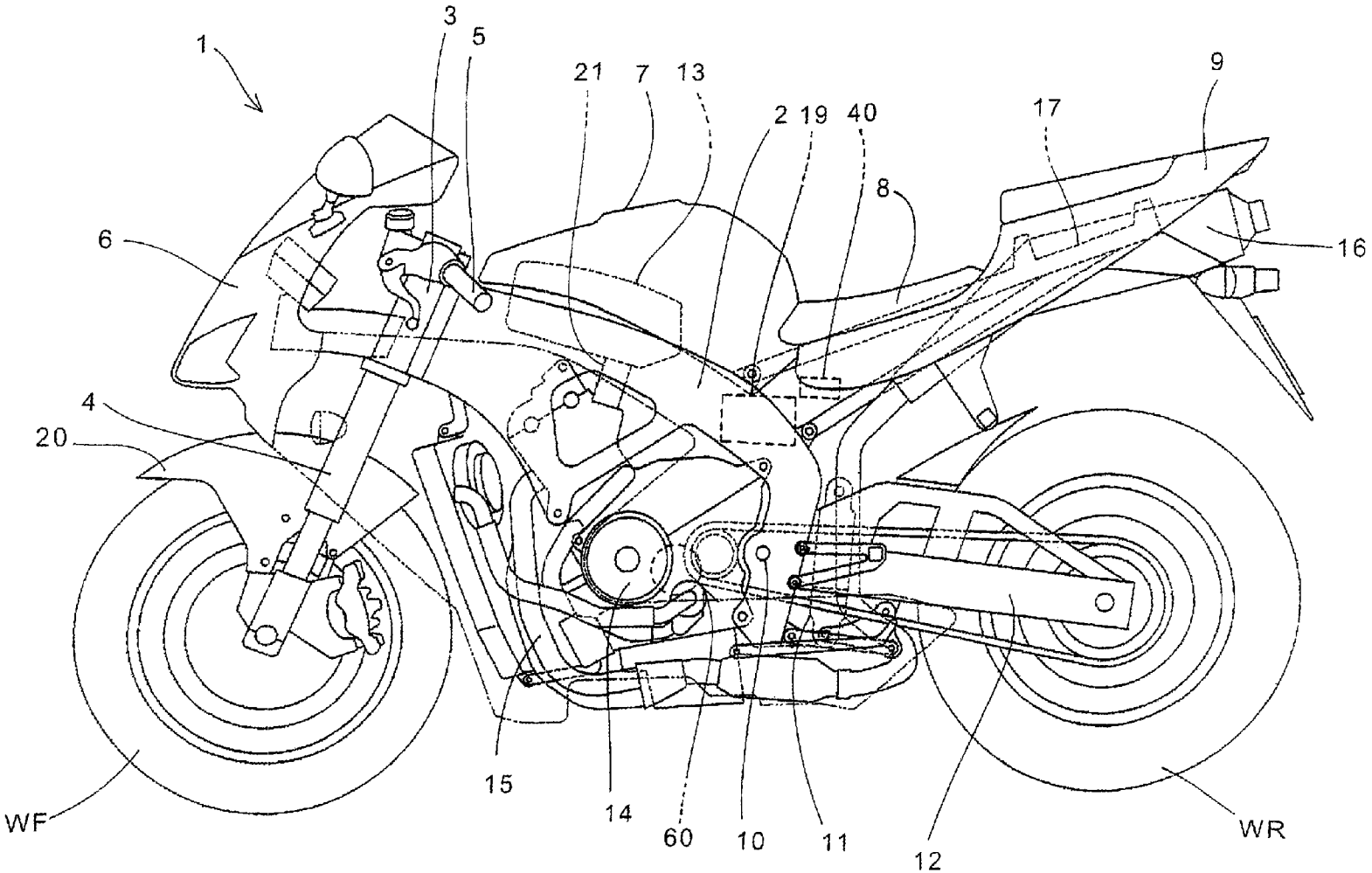
FIG. 1 is a side view of a motorcycle incorporating a fuel injection control system according to the present invention.

Preferred embodiments of the present invention will be explained hereinafter in detail with reference to the drawings. FIG. 1 is a side view of a motorcycle 1 incorporating a fuel injection control system according to the present invention. A steering stem (not shown) is rotatably journaled to a head pipe 3 that is provided at a front end portion of a main frame 2. A pair of front forks 4 to which a front wheel WF is rotatably journaled are attached to the steering stem. The front wheel WF is adapted to be steered by a pair of handlebars 5 that are attached to upper ends of the front forks 4.

A swing arm 12 to which a rear wheel WR serving as a drive wheel is rotatably journaled is swingably journaled to a rear lower portion of the main frame 2 by a pivot axis 10. A rear cushion 11 is provided between the swing arm 12 and the main frame 2.

An engine 14 is provided in front of the pivot axis 10 and under the main frame 2. Within an interior of the engine 14, a multi-stage transmission, for example, a six-stage transmission is housed. An intake pipe 21 that contains a fuel injection device and a throttle body is attached to an upper portion of the engine 14 and an air cleaner box 13 is connected to an upper portion of the intake pipe. An exhaust pipe 15, which conducts combusted gas from the engine 14 to a muffler 16 provided at a vehicle body rear end portion, is attached to a front side of the engine 14.

A front cowl 6 is provided at a front side of the head pipe 3. A front fender 20 is provided above the front wheel WF. A fuel tank 7 is provided on an upper portion of the main frame 2. A seat 8 and a seat cowl 9 are attached to a seat frame 17 that extends rearward/upward from the main frame 2. A battery 19 and an ECU 40 including the fuel injection control system according to the present invention are provided below the seat 8.

Figure 2:
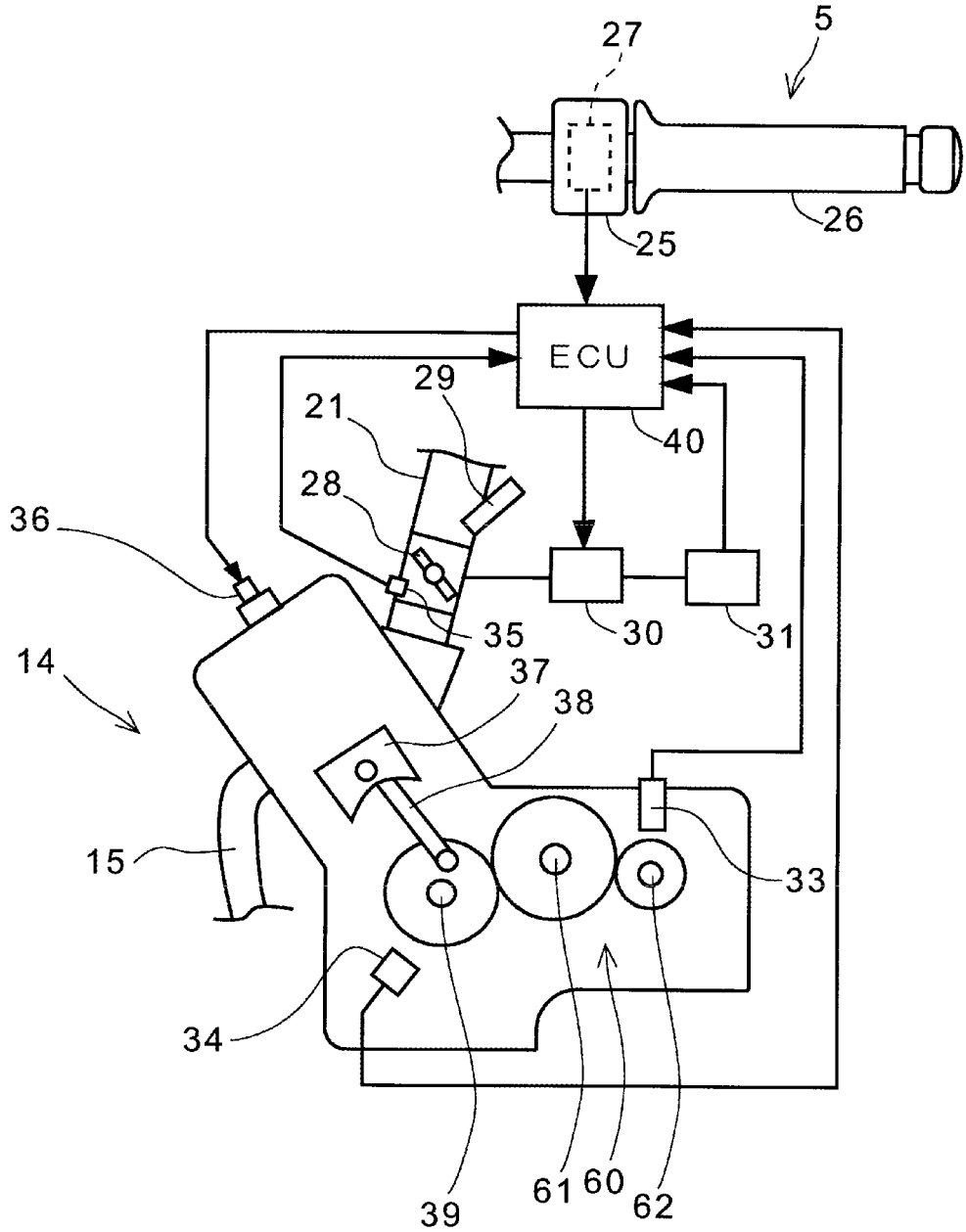
FIG. 2 is a block diagram illustrating a configuration of a throttle-by-wire mechanism.

FIG. 2 is a block diagram illustrating a structure of a throttle-by-wire system. The same reference signs as in the above designate the same or equivalent portions. At the engine 14 that is provided with a spark plug 36 and serves as an internal combustion engine, a crankshaft 39 to which a connecting rod 38 supporting a piston 37 is connected, and a main shaft 61 and a counter shaft 62 that support a plurality of gear couples and constitute the transmission 60 are provided. An engine revolution sensor 34 is arranged adjacent the crankshaft 39 and detects the revolution number (speed) of the crankshaft 39. A gear position sensor 33 that detects a speed-change stage number of the transmission 60 is provided adjacent the counter shaft 62 in order to detect an operation condition of a transmission system such as a shift drum, etc.

At the intake pipe 21, a throttle valve 28 changing a passage area of the intake pipe, an intake pressure sensor 35, and a fuel injection valve (injector) 29 are provided. The throttle-by-wire system (TBW) that drives the throttle valve 28 via a throttle valve motor 30, serving as an actuator, based on various sensor outputs is applied to the throttle device.

A rotation angle of a throttle grip 26 attached to the handlebar 5 on the right side in a vehicle width direction and rotation-operated by an operator is detected by a throttle grip opening sensor 27 within a switch box 25 and transmitted to the ECU 40. The ECU 40 drives the throttle valve motor 30, based on the various sensor output signals in addition to the rotation angle of the throttle grip 26. A rotation angle of a throttle valve 28 is detected by a throttle valve opening sensor 31 and transmitted to the ECU 40. The ECU 40 performs fuel injection control, throttle valve drive control, and ignition control of the spark plug, based on the sensor outputs.

Figure 3:
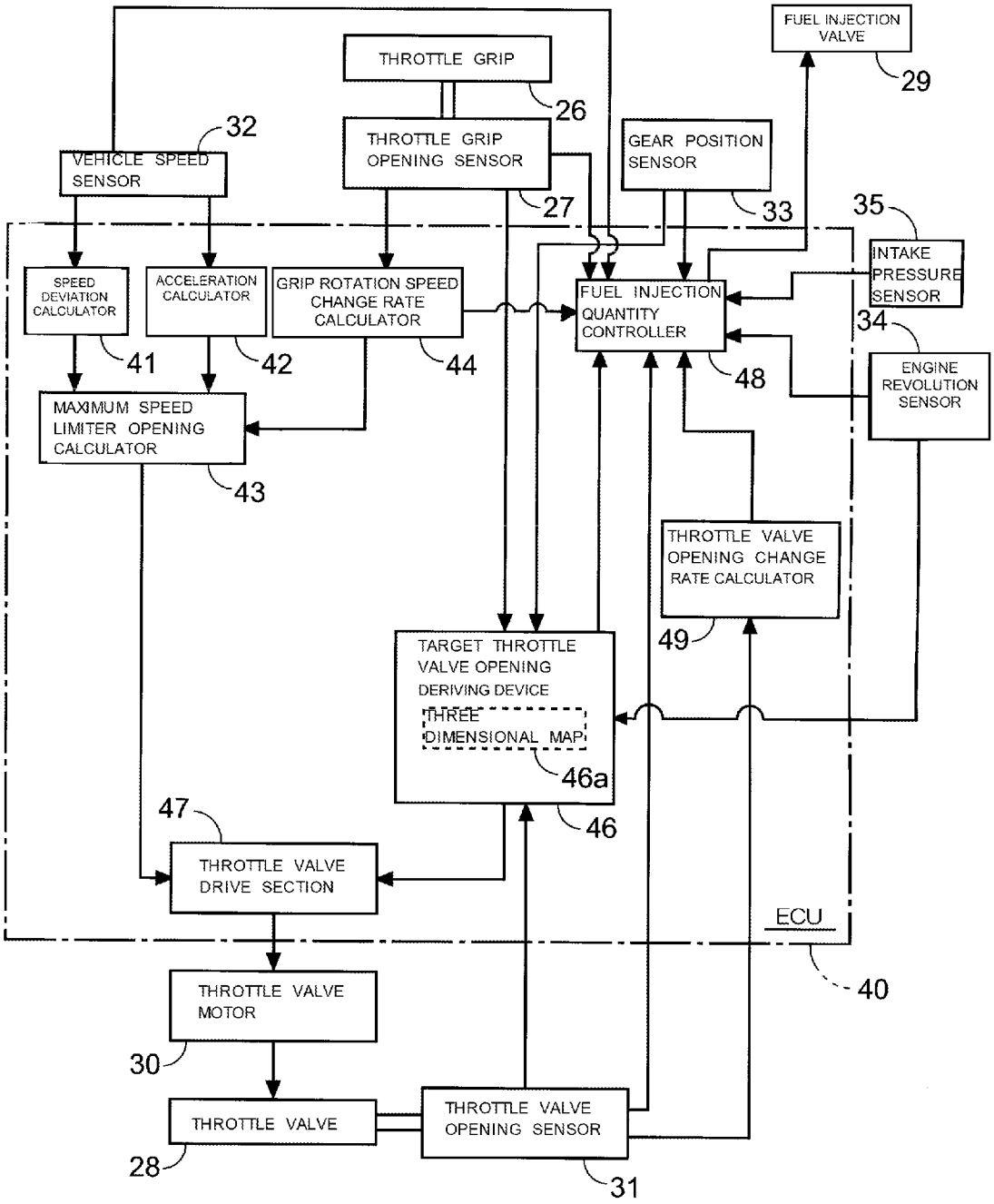
FIG. 3 is a block diagram illustrating configurations of a vehicle speed control device and peripheral instruments.

FIG. 3 is a block diagram illustrating the ECU 40 and structures of peripheral instruments according to the present invention. The same reference signs as in the above denote the same or equivalent portions. The ECU 40 includes fuel injection quantity controller 48, throttle valve opening change rate calculator 49, target throttle valve opening deriving device 46, a throttle valve drive section 47, grip rotation speed change rate calculator 44, speed deviation calculator 41, acceleration calculator 42, and maximum speed limiter opening calculator 43.

Output signals from the throttle grip opening sensor (throttle operation condition detector) 27, the gear position sensor 33, the engine revolution (speed) sensor 34, and the throttle valve opening sensor 31 are inputted to the target throttle valve opening deriving device 46. A three-dimensional map **46*a* that is contained in the target throttle valve opening deriving device 46 is a data map that derives a target throttle valve opening (hereinafter referred to as a target TH valve opening E) from the throttle grip opening and the engine revolution number. In this embodiment, the map having a number that corresponds to the gear stage number of the transmission 60 (for example, if the transmission 60 is a six-stage transmission, the number is six) is prepared. Moreover, the grip rotation speed change rate calculator 44 calculates a change rate (ΔTHG) of the rotation speed of the throttle grip 26** operated by the operator.

The throttle valve drive section 47 drives the throttle valve motor 30, based on the target TH valve opening E derived by the target throttle valve opening deriving device 46. Incidentally, the maximum speed limiter opening calculator 43 is configured so as to drive-limit the throttle valve drive section 47 as a maximum speed limiter to cause a vehicle speed to not exceed a maximum speed previously set in spite of the target TH valve opening E.

A fuel injection quantity from the fuel injection valve (injector) 29 is determined by the fuel injection quantity controller 48. Output signals from the throttle valve opening sensor 31, the throttle valve opening change rate calculator 49, the target throttle valve opening deriving device 46, the engine revolution sensor 34, the intake pressure sensor 35, the gear position sensor 33, the throttle grip opening sensor 27, and the vehicle speed sensor 32 are inputted to the fuel injection quantity controller 48. The fuel injection quantity controller 48 mainly determines the fuel injection quantity according to a real opening of the throttle valve 28 that is detected by the throttle valve opening sensor 31.

In the throttle device employing the TBW system, there is a possibility that the real throttle valve opening (hereinafter referred to as a real TH valve opening F) over-shoots and under-shoots relative to the target TH valve opening E calculated by the target throttle valve opening deriving device 46, due to mechanical characteristics of the gears, springs, etc., that are contained within an interior of the throttle valve motor 30 and a power transmission system for the throttle valve 28. Influences exerted on the fuel injection control by the over-shoot and the under-shoot will be explained with reference to FIG. 15.

Figure 15:
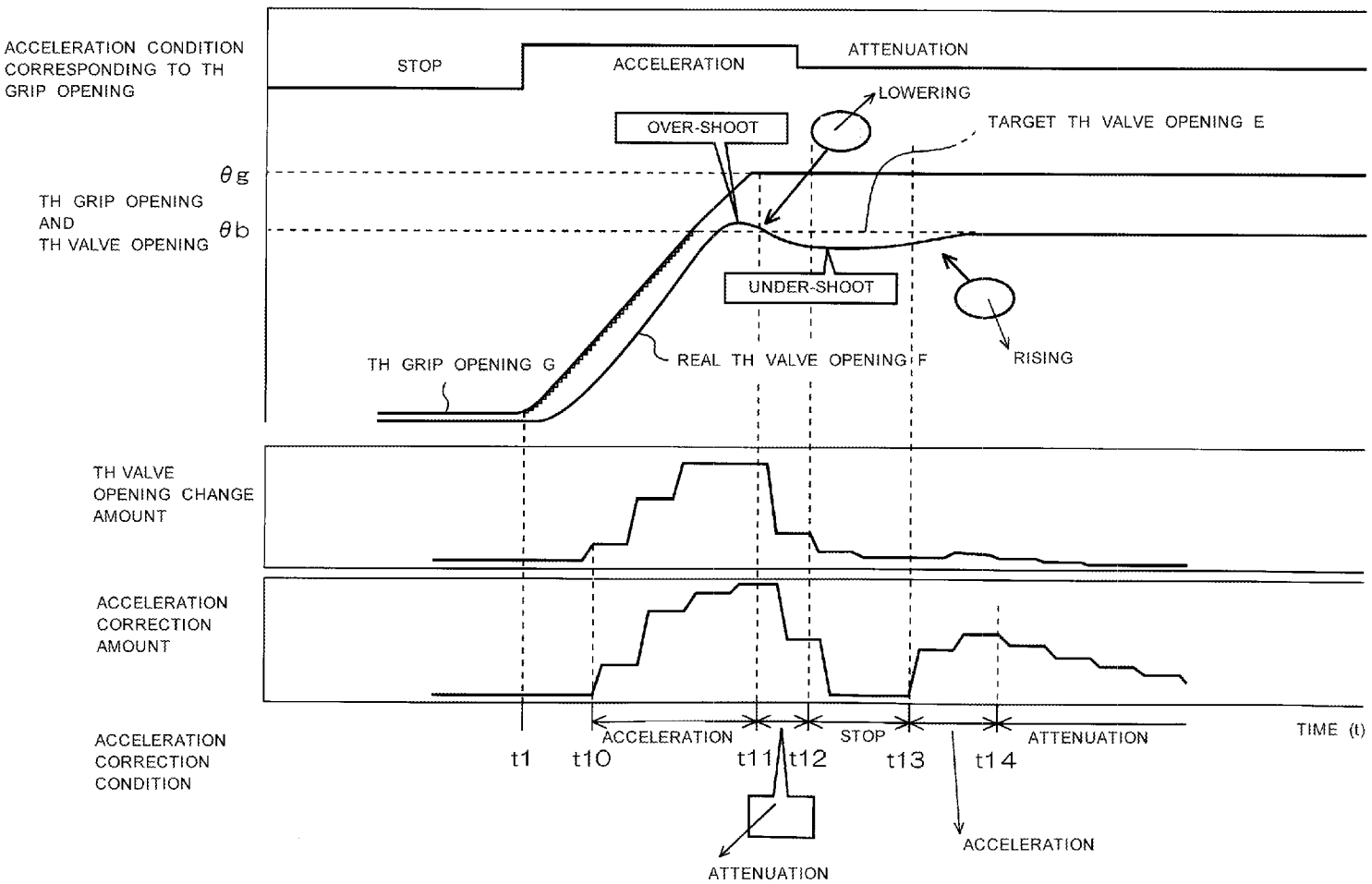
FIG. 15 RELATED ART
FIG. 15 is a time chart illustrating a flow of fuel injection control in a case where acceleration operation is carried out by an occupant in the related art.

FIG. 15 is a time chart illustrating a flow of the fuel injection control in a case where acceleration operation by the occupant is carried out in a related art. This time chart shows, from top to bottom, an acceleration condition corresponding to the TH (throttle) grip opening, the TH grip opening and the TH valve opening, a change amount of the TH valve opening, an acceleration correction amount (acceleration correction fuel injection quantity), and an acceleration correction condition. Incidentally, indication of the TH valve opening includes the target TH valve opening E indicated by a broken line and the real TH valve opening F indicated by a solid line.

In this graph, opening-operation of the TH grip 26 is started at time t1, and a condition where the TH grip 26 is quickly opened to a predetermined opening θg is shown. At this time, the target TH valve opening E indicated by the broken line rises with the TH grip opening G and, thereafter, becomes constant at a predetermined opening θb.

However, the real TH valve opening F of the throttle valve 28 driven by the throttle valve motor 30 starts up slightly late from starting-up of the target TH valve opening E. Thereafter, over-shoot that exceeds the predetermined opening θb occurs due to the mechanical characteristics such as gears, springs, etc. contained in the actuator and the throttle device and, successively, under-shoot that is less than the predetermined opening θb occurs.

In acceleration correction control that increases the fuel injection quantity in correspondence with acceleration movement, the acceleration correction amount is generally determined in correspondence with the real TH valve opening F. Thus, if the real TH valve opening F is increased, this is considered to be in the acceleration condition and increase correction is performed and, if the real TH valve opening F is shifted to a constant condition or decreased, this is considered to be a non-acceleration condition and the increase correction is set so as to be attenuated or stopped. In such a fuel injection control system, if the over-shoot and the under-shoot occur in the real TH valve opening F, the following phenomenon occurs.

In the related art example shown in FIG. 15, when the real TH valve opening F is lowered after the over-shoot, it is judged that the vehicle is in a deceleration condition. Thereby, the acceleration correction that is started from time t10 is shifted to "attenuation" in which the acceleration correction amount is gradually decreased at time t11, and further shifted to "stop" in which the acceleration correction amount is made zero at time t12. Successively, when the real TH valve opening F rises after the under-shoot, it is judged that the vehicle is in the acceleration condition, and the acceleration increase correction is again performed by "acceleration" during a period of time t13-t14.

According to this phenomenon, the increase correction is quickly performed according to the quick opening of the TH grip 26 to the predetermined opening θg, but thereafter the fuel injection quantity is increased or decreased although the TH grip 26 is maintained at the predetermined opening θg, so that there is a possibility that an engine performance and a riding feeling does not match the throttle operation of the operator, leading to an undesirable riding experience.

To the contrary, with the fuel injection control system according to the present invention the operation condition of the TH grip 26 as well as the real TH valve opening F is taken into consideration whereby the acceleration correction control is carried out without being affected by over-shoot and under-shoot that may occur in the real TH valve opening F.

Figure 4:
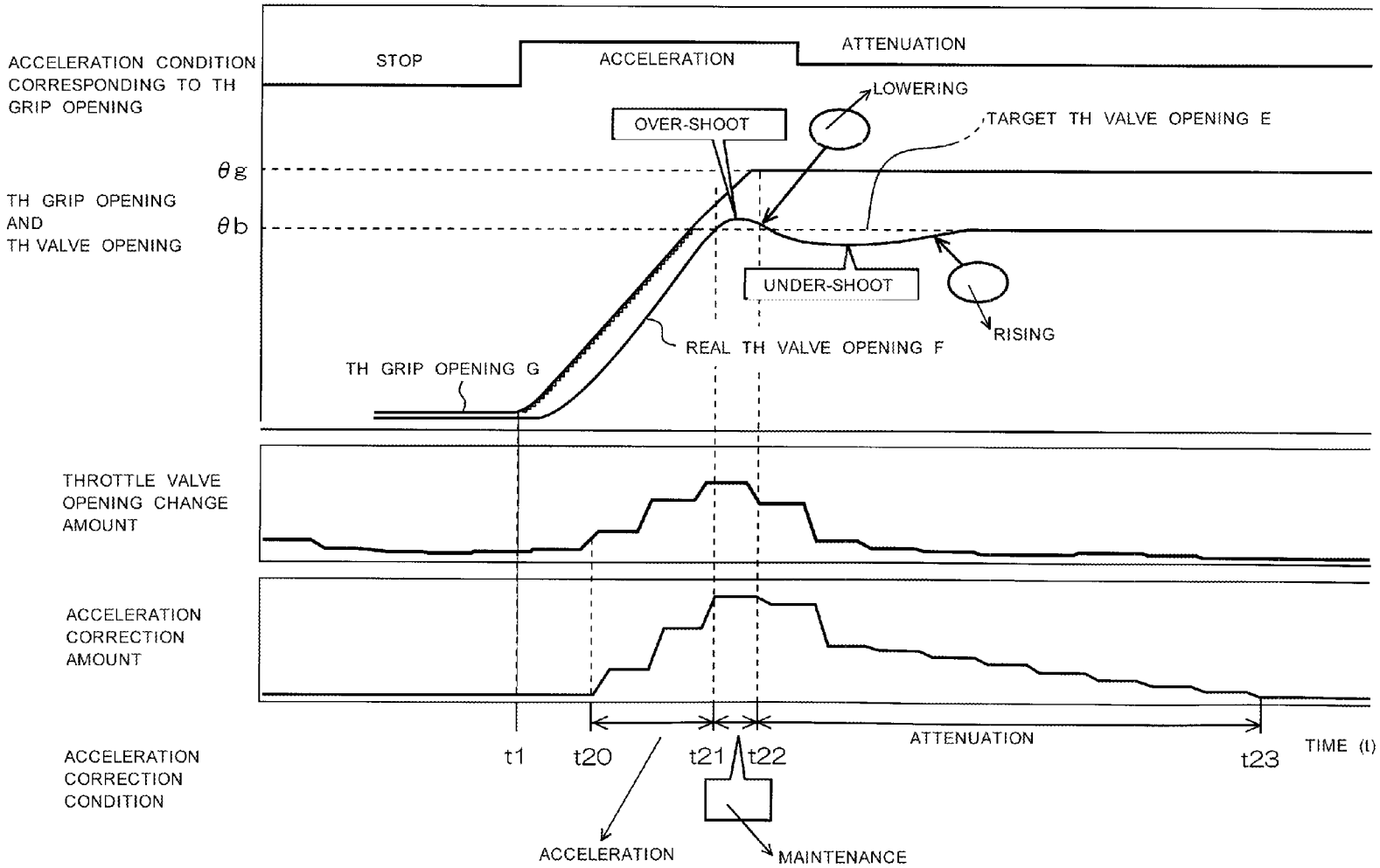
FIG. 4 is a time chart showing a flow of fuel injection control in a case where an operator performs acceleration-operation.

FIG. 4 is a time chart illustrating a flow of the fuel injection control when the operator performs acceleration-operation with the fuel injection device according to the present invention. In this time chart, like FIG. 15, the opening operation of the TH grip 26 by the operator is started at time t1 and the TH grip 26 is quickly opened to the predetermined opening θg. After the real TH valve opening F set up slightly late from the target TH valve opening E, over-shoot that exceeds the predetermined opening θb occurs and, successively, under-shoot that is less than the predetermined opening θb occurs.

The acceleration correction that is started at time t20 is set such that the acceleration correction amount is still "maintained" for a period of time t21-t22, even though the real TH valve opening F is shifted to lowering after the over-shoot started from the time t21. Moreover, the acceleration correction is switched to "attenuation" from time t22 and, thereafter, even though the real TH valve opening F is turned to "rise" after under-shooting, the acceleration correction is not turned to "acceleration", the acceleration correction amount is slightly attenuated until time t23, and the sequence control is finished. As described above, according to the fuel injection device according to the present invention, the phenomenon in which the acceleration correction amount is increased and decreased in spite of the TH grip opening G being constant does not occur.

FIG. 5 is a table that shows a relationship between the operation condition of the TH valve 28, the operation condition of the TH grip 26, and the acceleration correction condition. The acceleration condition is set so as to include "maintenance" in which the acceleration correction amount is maintained or unchanged, "continuation" in which an arithmetical process of the acceleration correction amount is continued (i.e., as may be represented from time t20-t21 in FIG. 4), "attenuation" in which the acceleration correction amount is slightly attenuated, and "stop" in which the acceleration correction amount is made to be zero.

The operation condition of the TH valve 28 is judged to be in one of two states, "whether the TH valve is in a drive state in an opening direction" and "whether the TH valve is in a stop state or a drive state in a closing direction", based upon the real TH valve opening F detected by the TH valve opening sensor 31.

On the other hand, the operation condition of the TH grip 26 is judged to be in one of three states, "the TH grip is in an opening direction (the TH grip condition=2)", "the TH grip is in a stop state (the TH grip condition=1)", and "the TH grip is in a closing direction or a fully closing state (the TH grip condition=0)".

The acceleration correction condition, in the case where the operation condition of the TH valve 28 is in the state where "the TH valve is in a stop state or a drive state in a closing direction", is set to the "maintenance" (5) if the TH grip condition=2, is set to the "attenuation" (6) if the TH grip condition=1, and is set to the "stop" (7) if the TH grip condition=0.

According to the setting described above, even if the real TH valve opening F is lowered after the over-shoot, whereby "the TH valve is in stop or in drive in a closing direction", the acceleration correction condition becomes "maintenance" (5) if the TH grip 26 is opened or "attenuation" (6) if the TH grip 26 is in stop. Thereby, the acceleration correction is not made to "stop" though the occupant opens the throttle, and it is possible to prevent an unmatched action from occurring between the throttle operation and the acceleration correction.

On the other hand, the acceleration correction condition, in the case of the operation condition of the TH valve 28 being in the "drive state in the opening direction", is set to "maintenance" (1) or "continuation" (2) if the TH grip condition=2, is set to "attenuation" (3) if the TH grip condition=1, and is set to "stop" (4) if the TH grip condition=0.

Figure 14:
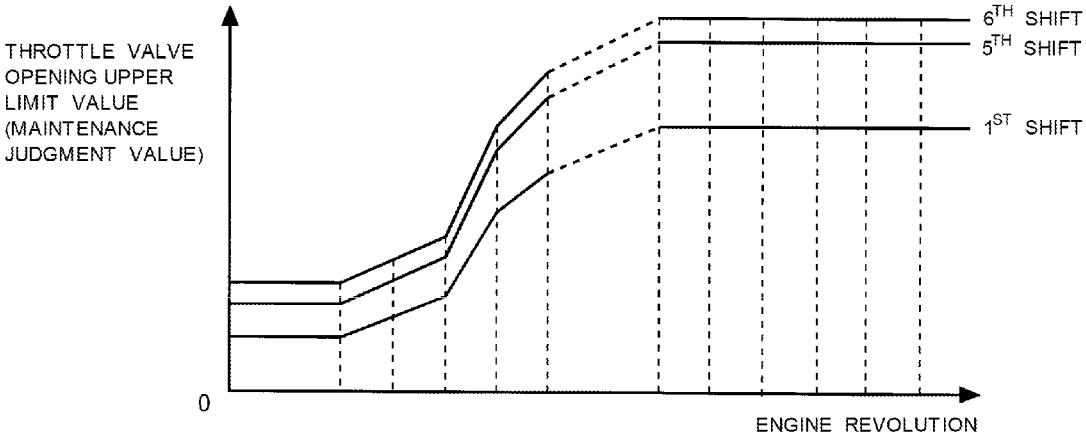
FIG. 14 is a data map of a maintenance judgment value corresponding to a gear stage number of a transmission and an engine revolution number (speed).

In the case where the TH grip condition=2, either "maintenance" or "continuation" is selected based on the condition judgment on the target TH valve opening E. Namely, if the TH grip condition=2 and the target TH valve opening E is larger than a maintenance judgment value H, the acceleration correction condition is set to "maintenance" (1) and, on the other hand, if the TH grip=2 and the target TH valve opening E is less than the maintenance judgment value H, the acceleration correction condition is set to "continuation" (2). The maintenance judgment value H is an upper limit value of the target TH valve opening E which corresponds to the gear stage number of the transmission 60 and the engine revolution speed and is derived from a data map (refer to FIG. 14) previously provided by experiments and the like.

Further in accordance with the setting described above, even if the real TH valve opening F rises after the under-shoot, whereby "the TH valve is in drive in the opening direction", when the TH grip 26 is in stop at a given opening or in the closing direction, the acceleration correction is made to "attenuation" (3) or "stop" (4). Thereby, the acceleration correction is not made to "maintenance" or "continuation" while the occupant closes the throttle, and it is possible to prevent an unmatched action from occurring between the throttle operation and the acceleration correction. The details of procedures of the fuel injection control described above will be explained with reference to flow charts of FIGS. 6 to 13.

Figure 6:
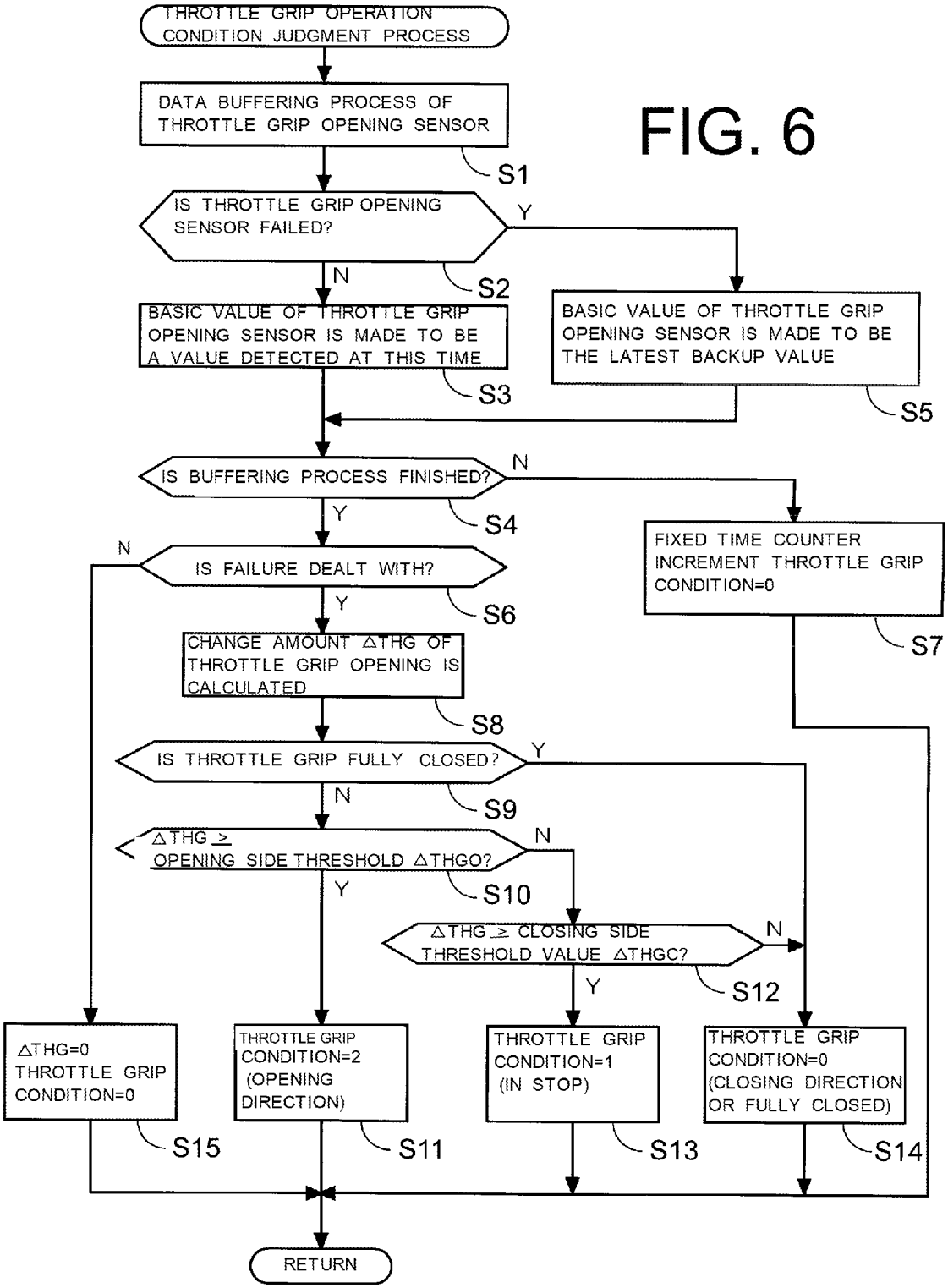
FIG. 6 is a flow chart showing procedures of a throttle grip operation condition judging process.

FIG. 6 is a flow chart showing procedures of throttle grip operation judgment process. According to this flow chart, in the operating condition of the TH grip which is shown in the list of FIG. 5, it is judged that the TH grip 26 is any of the opening direction (TH grip condition=2), stop (TH grip condition=1), and the closing direction or fully closing (TH grip condition=0).

In step S1, data buffering process of the throttle grip opening sensor (hereinafter referred to as a TH grip opening sensor) 27 is performed. In step S2, it is judged whether the TH grip opening sensor 27 has failed and, if a negative judgment is made, the process progresses to step S3. In the step S3, a standard value of the TH grip opening sensor 27 is set to a value which is detected at this time and the process progresses to step S4.

Incidentally, in the step S2, if a positive judgment is made, namely, if it is judged that the TH grip opening sensor 27 has failed, the process progresses to step S5, the standard value of the TH grip opening sensor 27 is set to a latest backup value set before the failure, and the process progresses to step S4.

In the step S4, it is judged whether the data buffering process of the TH grip opening sensor 27 has been completed and, if a positive judgment is made, the process progresses to step S6. In the step S6, it is judged whether the failure of the TH grip opening sensor 27 has been dealt with and, if a positive judgment is made, the process progresses to step S8 in which the change amount ΔTHG of the TH grip opening G is calculated. This change amount ΔTHG is calculated by the grip rotation speed change rate calculator 44.

In step S9, it is judged whether the TH grip 26 is fully closed and, if a negative judgment is made, the process progresses to step S10. On the other hand, if a positive judgment is made in the step S9, the process progresses to step S14 and the sequent control is finished as the TH grip condition=0.

Incidentally, if a negative judgment is made in the step S4, the process progresses to step S7, a fixed time counter to detect the completion of the buffering process is incremented and the sequent control is finished as the TH grip condition=0. Moreover, if a negative judgment is made in the step S6, the process progresses to step S15, the change amount ΔTHG of the TH grip opening G is set as ΔTHG=0 and the sequent control is finished as the TH grip condition=0.

In step S10, it is judged whether ΔTHG calculated in the step S8 is larger than the opening side threshold value ΔTHGO and, if a positive judgment is made, the process progresses to step 11 and it is judged that the TH grip condition=2. On the other hand, if a negative judgment is made in the step S10, the process progresses to step S12 in which it is judged whether ΔTHG is larger than a closing side threshold value ΔTHGC. Moreover, if a positive judgment is made in the step S12, the process progresses to step S13 in which it is judged that the TH grip condition=1. If a negative judgment is made in the step S12, the process progresses to step S14 in which it is judged that the TH grip condition=0, and the sequent control is finished.

Figure 7:
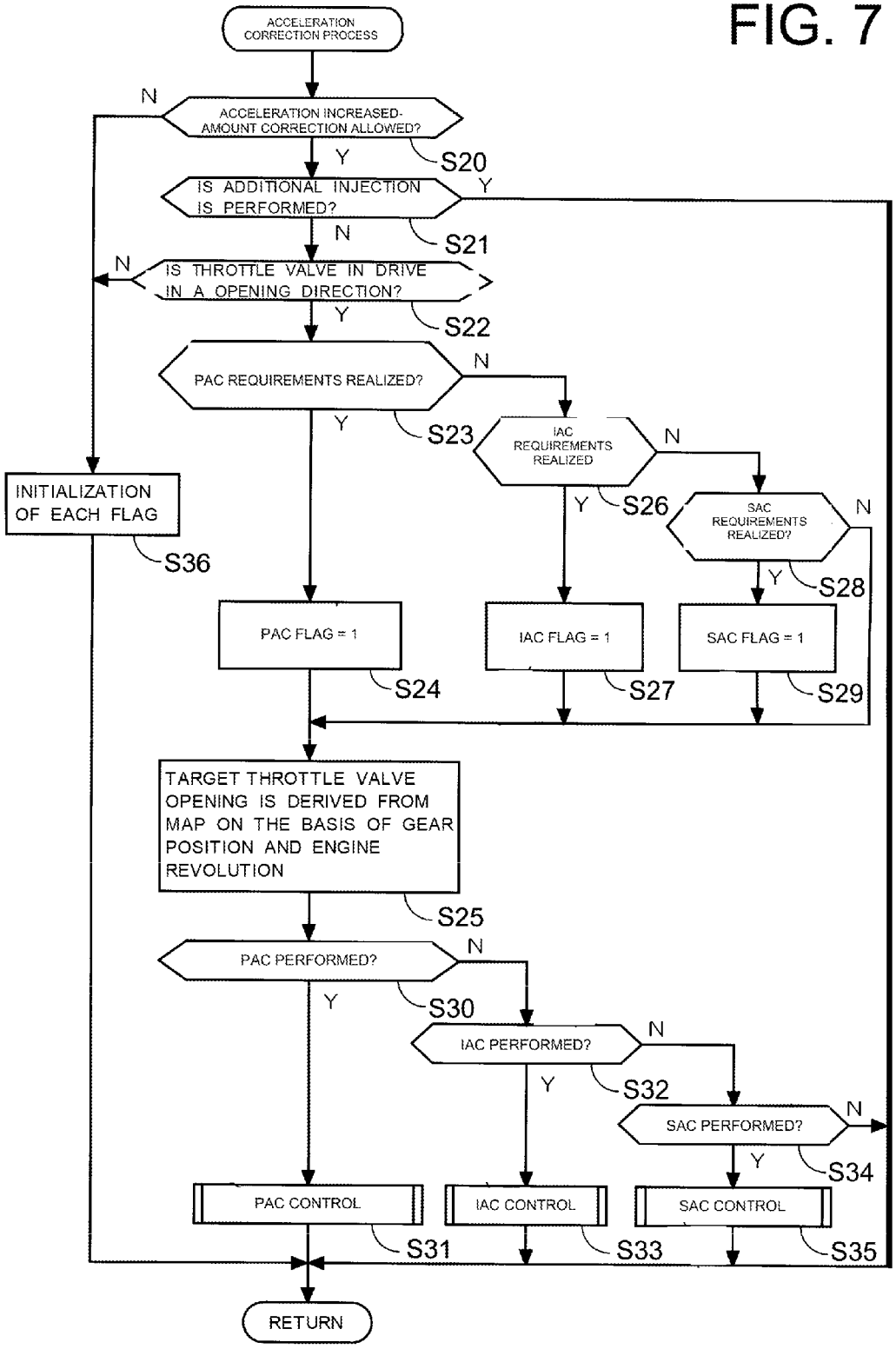
FIG. 7 is a flow chart illustrating procedures of an acceleration correction process.

FIG. 7 is a flow chart showing the procedures of the acceleration correction process. In the fuel injection control system according to the present invention, three types of acceleration correction control consist of partial acceleration correction, ignition acceleration correction, and snap acceleration correction. The partial acceleration correction is performed at an acceleration time from a state (partial) where the TH valve 28 is opened to a certain degree and the fuel increased-quantity is made about middle. The ignition acceleration correction is performed at an acceleration time when the TH valve is opened after it is fully closed or once closed and then opened, whereby the fuel increased-quantity is made larger to quickly follow the acceleration intention of the operator (in order to make ignition well). The snap acceleration correction is performed at a time when engine load is small, for example, at an idling (snap) time, and the fuel increased-quantity is made smaller.

First of all, in step S20, it is judged whether acceleration increased-quantity correction is allowed and, if a positive judgment is made, the process progresses to step S21. In the step S21, it is judged whether the fuel injection device is in additional injection. Additional injection is fuel injection that is additionally performed since fuel injection corresponding to a normal calculating timing is finished when the acceleration condition is detected at a timing after the normal calculating timing of the fuel injection quantity. This additional injection does not synchronize with the normal calculating timing, so that it is called a non-synchronizing acceleration. Incidentally, if a positive judgment is made in step S21, the acceleration correction at the normal injection timing is considered to be unable to be performed, and the sequent control is finished.

In step S22, it is judged whether the TH valve 28 is in drive in the opening direction and, if a positive judgment is made, the process progresses to step S23. Incidentally, the judgment in the step S22 corresponds to the judgment as to which of the two patterns the operation condition of the TH valve shown in FIG. 5 is. Next, in the step S23, it is judged whether the requirements for performing the partial acceleration correction (PAC) are realized and, if a positive judgment is made, a partial acceleration correction flag (PAC flag) is set to 1 in step S24. Moreover, if a negative judgment is made in the step S23 then, in step S26, it is judged whether the requirements for performing the ignition acceleration correction (IAC) are realized and, if a positive judgment is made, an ignition acceleration correction flag (IAC flag) is set to 1 in step S27. Moreover, if a negative judgment is made in the step S26, then it is judged in step S28 whether requirements for performing the snap acceleration correction (SAC) are realized in step S28 and, if a positive judgment is made, a snap acceleration correction flag (SAC flag) is set to 1 in step S29. If a negative judgment is made in the step S28, any acceleration correction requirements are considered not to be realized and the process progresses to step S25.

In step S25, the target TH valve opening E is derived from the three-dimensional map 46*a* (refer to FIG. 3) contained in the target throttle valve opening deriving device 46, on the basis of the gear position (gear stage number) of the transmission 60 and the engine revolution speed. In the following step S30, it is judged whether the partial acceleration correction (PAC) has been performed and, if a positive judgment is made, the process progresses to step S31 in which the partial acceleration correction control is continuously performed.

If a negative judgment is made in step S30, the process progresses to step S32 in which it is judged whether the ignition acceleration correction (IAC) has been performed and, if a positive judgment is made, ignition acceleration correction control is continuously performed in step S33. Moreover, if a negative judgment is made in step S32, the process progresses to step S34 in which it is judged whether the snap acceleration correction (SAC) has been performed and, if a positive judgment is made, the process progresses to step S35 in which snap acceleration correction control is continuously performed.

Incidentally, if the negative judgments are made in either step S20 or step S22, the process progresses to step S36 in which initialization of the respective flags is performed, and the sequent control is finished. Moreover, if a negative judgment is made in the step S34, namely, if it is judged that no acceleration correction is performed, the sequent control is finished.

Figure 8:
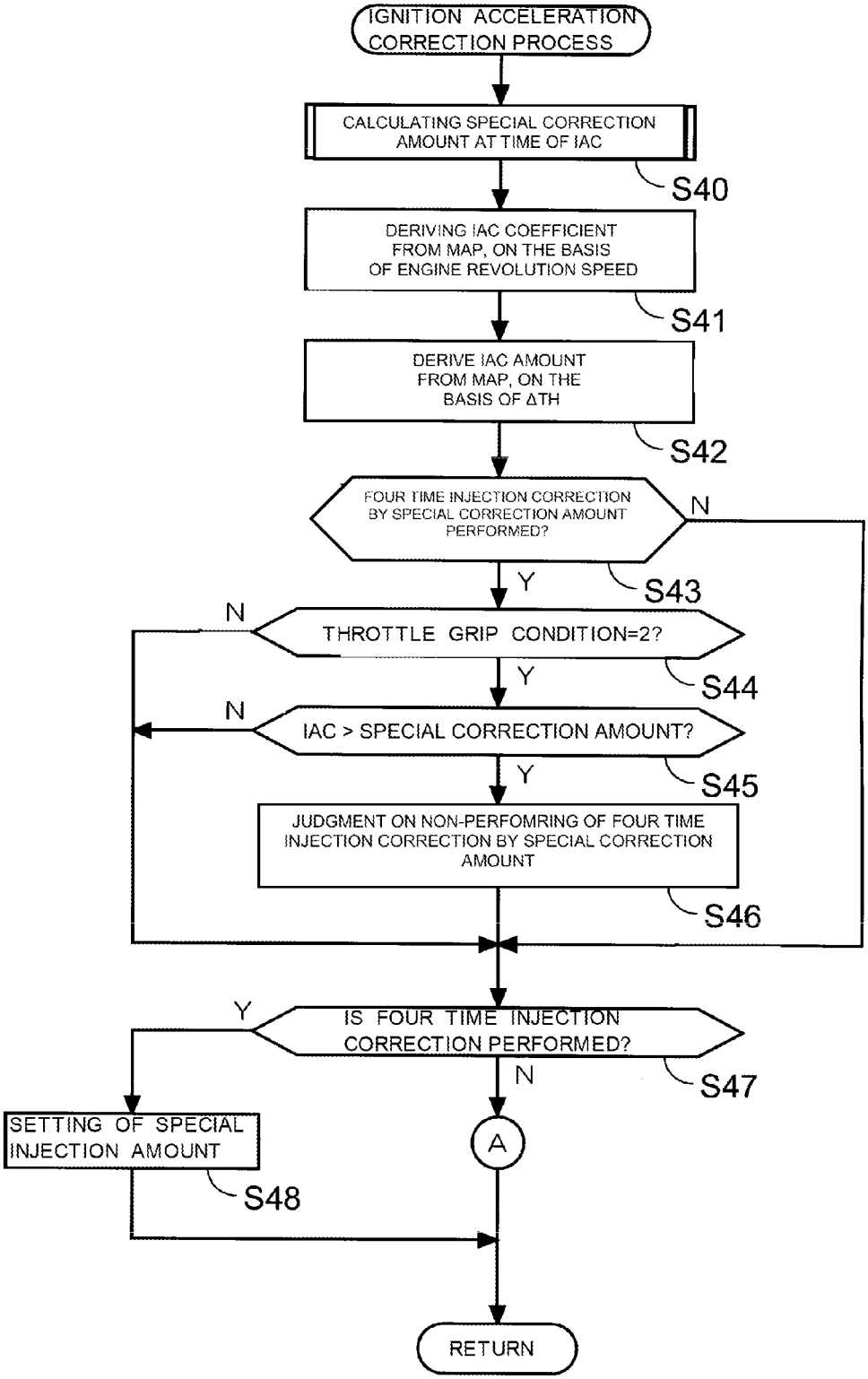
FIG. 8 is a flow chart showing procedures of an ignition acceleration correction process.

FIG. 8 is a flow chart illustrating the procedures of the ignition acceleration correction process. As described above, the ignition acceleration correction is to quickly increase the engine revolution speed at the acceleration time when the TH valve 28 is opened after it is fully closed or once closed. In this embodiment, the ignition acceleration correction is performed with "four time injection at a special correction amount" to increase response (ignition) to the throttle operation. First of all, in step S40, the special correction amount at the time of ignition acceleration correction (IAC) is calculated. Now, a sub flow which is shown in FIG. 10 and illustrates the procedures of special correction amount calculating process at the time of the ignition acceleration correction is referred to.

Figure 10:
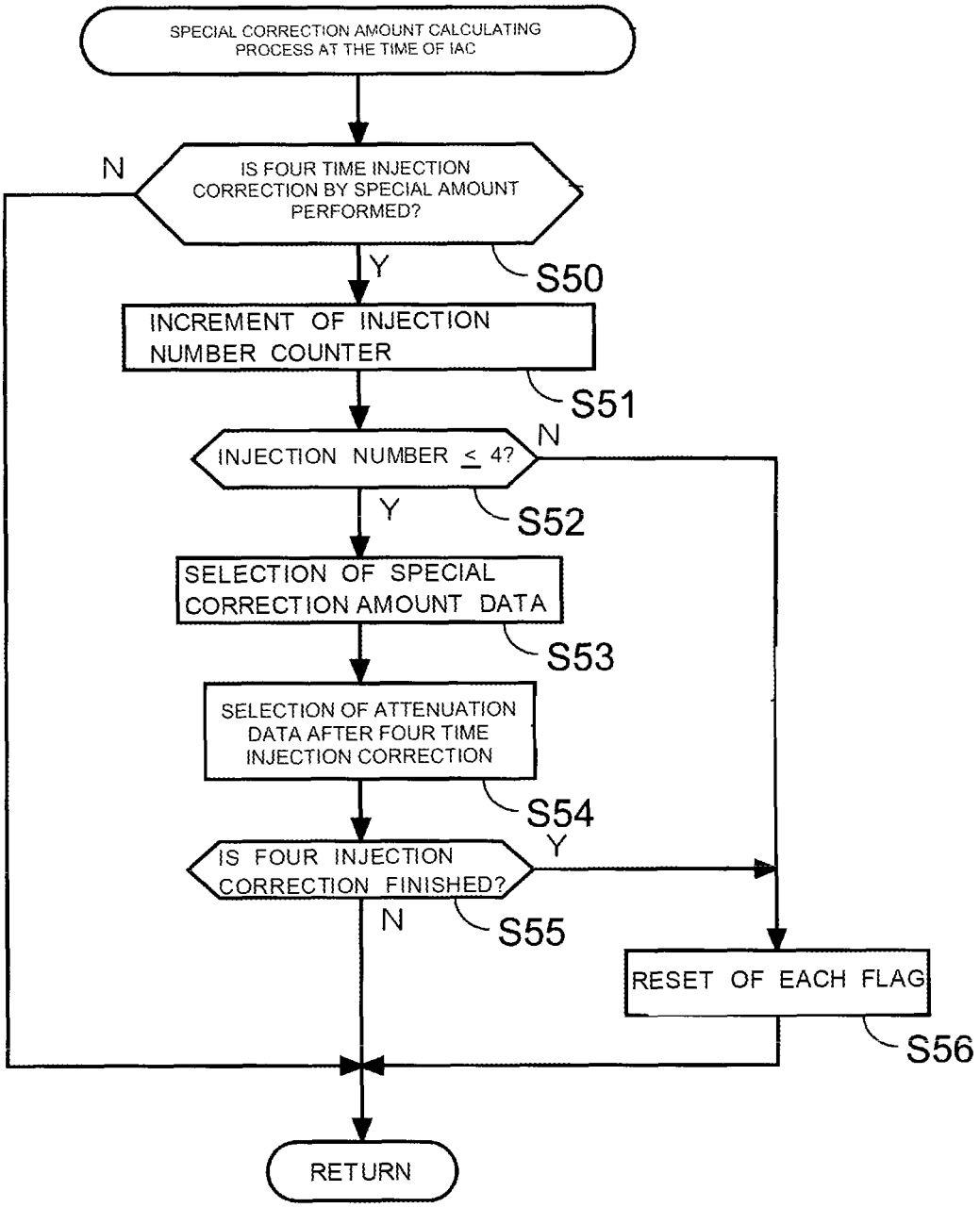
FIG. 10 is a sub flow chart showing procedures of a special correction amount calculating process at the time of the ignition acceleration correction.

In step S50 of the sub flow in FIG. 10, it is judged whether the four time injection correction at the special correction amount has been performed. If a positive judgment is made in the step S50, the process progresses to step S51 in which the injection number counter is incremented. In the following step S52, it is judged whether the injection number at the special correction amount is not more than four times and, if a positive judgment is made, the process progresses to step S53 in which a special correction amount data to be applied to in the next special injection is selected.

In the following step S54, selection of the attenuation data after the four time injection correction is performed. Then, in step S55, it is judged whether the four time injection correction is completed and, if a negative judgment is made, the process is returned to the main flow in FIG. 8.

Incidentally, if a negative judgment is made in the step S50, the process is returned to the main flow in FIG. 8. Moreover, if a negative judgment is made in the step S52 or a positive judgment is made in the step S55, namely, it is judged that the four time injection correction at the special correction amount is completed, the process progressed to step S56 in which the respective flags on the special correction amount is reset, and the process is returned to the main flow in FIG. 8.

The process is returned to the main flow in FIG. 8 and, in step S41, an injection acceleration correction coefficient is derived from a predetermined data map (not shown) on the basis of the engine revolution speed. In the step S41, the ignition acceleration correction (IAC) amount is derived from a data map (not shown) on the basis of ΔTH that is the change amount of the real TH valve opening F. Incidentally, the change amount ΔTH of the real TH valve opening F is calculated by the throttle valve opening change rate calculator 49 (refer to FIG. 3) of the ECU 40.

In the following step S43, it is judged whether the four time injection correction at the special correction amount determined in the sub flow of FIG. 10 has been performed. If a positive judgment is made in the step S43, the process progresses to step S44 in which it is judged whether the TH grip condition=2. If a positive judgment is made in the step S44, the process progresses to step S45 in which it is judged whether the ignition acceleration correction (IAC) amount derived in the step S42 exceeds the special correction amount.

If a positive judgment is made in the step S45, namely, if it is judged that the ignition acceleration correction amount is larger than the special correction amount, the process progresses to step S46. In the step S46, the four time injection correction at the special correction amount is considered not to be required to be performed and is not carried out, the ignition acceleration correction at the ignition acceleration correction amount is performed, and the process progresses to step S47. Incidentally, if negative judgments are made in the step S43, S44, S45, the process progresses to step S47.

Figure 9:
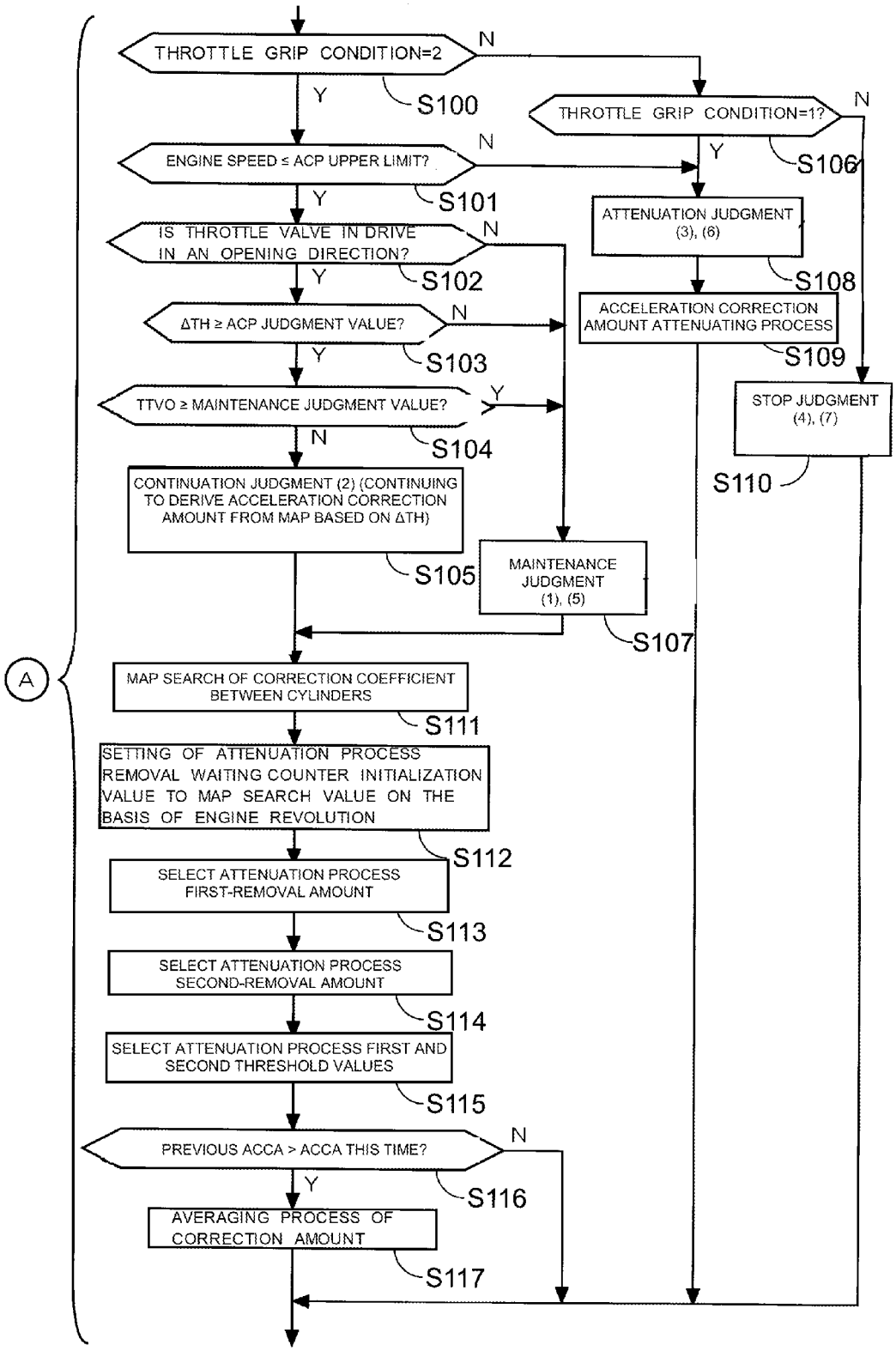
FIG. 9 is a sub flow chart of acceleration control which is common to all of ignition acceleration correction, partial acceleration correction, and snap acceleration correction.

In the step S47, it is judged whether the four time injection correction has been performed and, if a negative judgment is made, the process progresses to a sub flow A shown in FIG. 9. Now, FIG. 9 is referred to.

FIG. 9 is the sub flow A for the acceleration control which is common to all of the acceleration corrections (i.e., ignition acceleration correction, the partial acceleration correction, and the snap acceleration correction). In step S100, it is judged whether the TH grip condition=2 and, if a positive judgment is made, the process progresses to step S101. In step S101, it is judged whether the engine revolution speed is not more than an acceleration correction performing (ACP) upper-limit and, if a positive judgment is made, the process progresses to step S102. In step S102, it is judged whether the TH valve is in drive in the opening direction and, if a positive judgment is made, the process progresses to step S103.

In step S103, it is judged whether the change amount ΔTH of the TH valve opening is not less than an acceleration correction performing (ACP) judgment value and, if a positive judgment is made, the process progresses to step S104. In step S104, it is judged whether the target TH valve opening E (TTVO) is not less than the maintenance judgment value H. As described above, the maintenance judgment value H is the upper limit value of the TH valve opening E, which corresponds to the gear stage number of the transmission and the engine revolution, and is derived from the data map shown in FIG. 14.

If a negative judgment is made in the step S104, the process progresses to step S105 in which "a continuation judgment" to continue the control of deriving the acceleration correction amount from the map on the basis of the ΔTH is made. This "continuation" condition corresponds to the acceleration correction condition (2) shown in FIG. 5.

On the other hand, if negative judgments are made in the step S102, S103 or a positive judgment is made in the step S104, the process progresses to step S107 in which "maintenance judgment" to maintain the acceleration correction amount is made. Among these conditions, a condition where the positive judgment is made in the step S104 and which is shifted to the "maintenance" condition corresponds to the acceleration correction condition (1) shown in FIG. 5, and a condition where the negative judgment is made in the step S102 and which is shifted to the "maintenance" condition corresponds to the acceleration correction condition (5) shown in FIG. 5.

If a negative judgment is made in step S100, the process progresses to step S106 in which it is judged whether the TH grip condition=1. If a positive judgment is made in step S106, the process progresses to step S108 in which "attenuation judgment" to attenuate the acceleration correction amount is made. This "attenuation" condition corresponds to the acceleration correction condition (3), (6) shown in FIG. 5. In the following step S109, acceleration correction amount attenuating process is performed. Incidentally, if a negative judgment is made in the step S101, namely, if it is judged that the engine revolution speed exceeds the acceleration correction performing upper-limit, the process also progresses to the step S108 in which the "attenuation judgment" is made. The details of acceleration correction amount attenuating process of the step S109 will be described hereinafter.

On the other hand, if a negative judgment is made in step S106, the process progresses to step S110 in which "stop judgment" to stop the acceleration correction is made. This "stop" condition corresponds to the acceleration correction condition (4), (7) shown in FIG. 5.

Successively, determination of the attenuation amount in the attenuating process and equalizing process of an all-cylinder correction amount in a multi-cylinder engine are performed in steps S111-S117 after the continuation judgment is made in step S105. First of all, in step s111, a correction coefficient between cylinders is searched by a map (not shown). In step S112, an attenuation processing removal waiting counter initial value is set to a map (not shown) search value based on the engine revolution speed. In step S113, an attenuation process first stage removal amount (attenuation degree) is selected. In step S114, an attenuation process second stage removal amount (attenuation degree) is selected.

In step S115, attenuation process-first and second stage threshold values are selected. In step S116, it is judged whether the previous all-cylinder correction amount exceeds all-cylinder correction amount of this time and, if a positive judgment is made, the process progresses to step S117 in which an averaging process of the previous all-cylinder correction amount and the all-cylinder correction amount of this time is performed. If a negative judgment is made in step S116, the process is returned to the main flow of FIG. 8 as it is.

Figure 11:
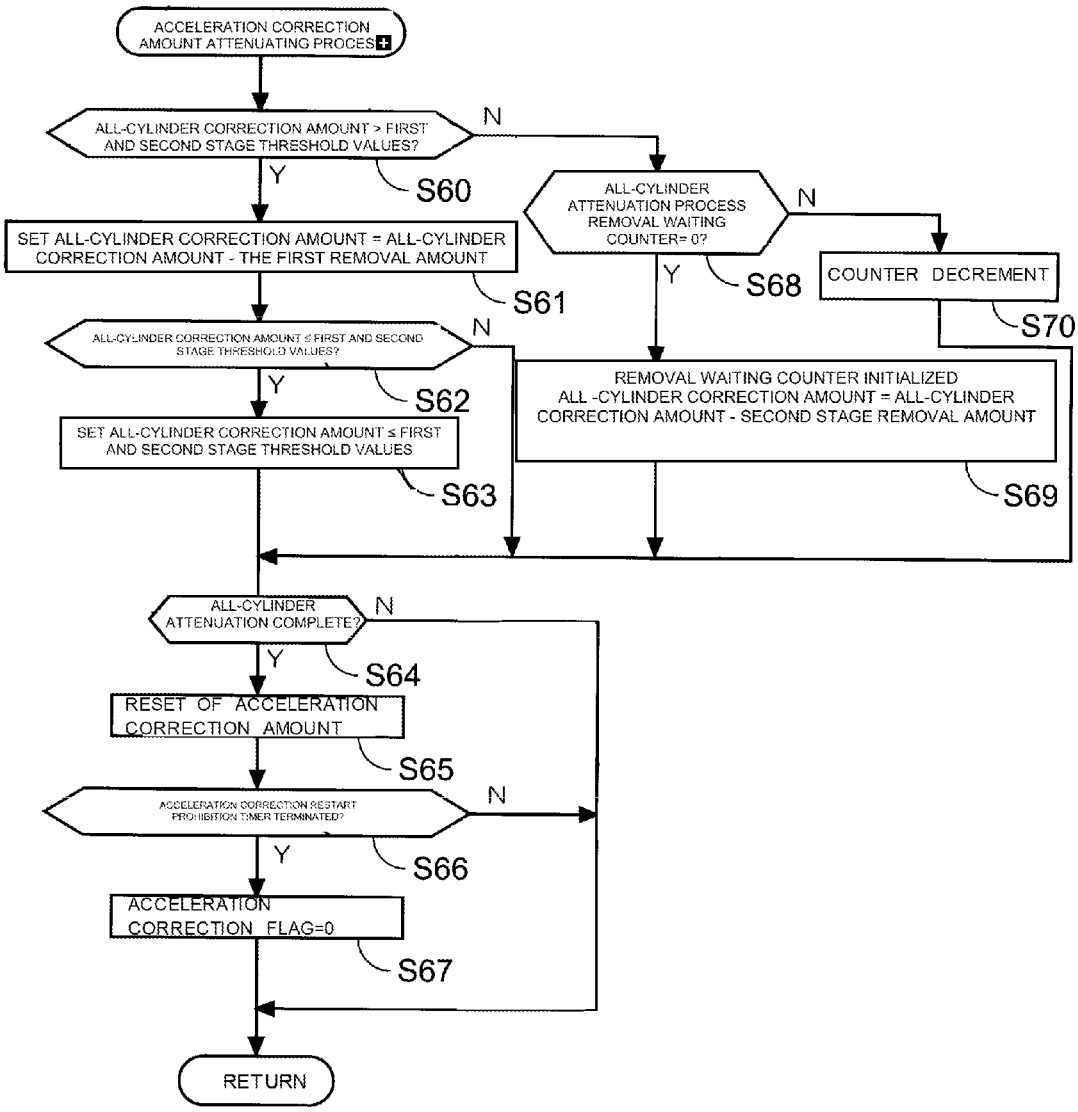
FIG. 11 is a sub flow chart illustrating procedures of an acceleration correction amount attenuating process.

In order to explain the acceleration correction amount attenuation process of step S109, a sub flow shown in FIG. 11 is now referred to. In step S60 of FIG. 11, it is judged whether the all-cylinder correction amount exceeds the first and second stage threshold amounts and, if a positive judgment is made, the process progresses to step S61. In the step S61, the all-cylinder correction amount is set to the all-cylinder correction amount-the first removal amount. In step S62, it is judged whether the all-cylinder correction amount is not more than the first and second stage threshold amounts and, if a positive judgment is made, the process progresses to step S63 in which the all-cylinder correction amount is set to the first and second stage threshold amounts, and the process progresses to step S64.

Incidentally, if a negative judgment is made in the step S60, then in step S68 it is judged whether the removal waiting counter of the all-cylinder attenuation process=0. If a positive judgment is made in the step S68, the process progresses to step S69 in which the removal waiting counter is set to an initial value (for example, 5) and the all-cylinder correction amount is set to the all-cylinder correction amount-the second stage removal amount, and the process progresses to step S64. On the other hand, if a negative judgment is made in the step S68, the decrement of the counter is performed in step S70, and the process progresses to step S64. According to such an attenuation process, it is possible to perform a smooth attenuation process by the application of the first stage removal amount (attenuation amount) and the second stage removal amount (attenuation amount).

In step S64, it is judged whether the attenuation process of the all-cylinder is completed. If a positive judgment is made in the step S64, the process progresses to step S65 in which the set value of the acceleration correction amount is reset. It is then judged in step S66 whether an acceleration correction restart inhabitation timer terminates and, if a positive judgment is made, the process progresses to step S67 in which the acceleration correction flag=0 is set, and the process is returned to the main flow of FIG. 10. Incidentally, according to the setting of the acceleration correction restart inhabitation timer, it is possible to prevent new acceleration correction from being performed during the previous acceleration correction. On the other hand, if negative judgments are made in step S64 or step S66, the process is returned to the flow of FIG. 9.

In the sub flow A of FIG. 9, if the process undergoes the acceleration correction amount attenuating process of the step S109, the process is returned to the main flow of the "ignition acceleration correction process" of FIG. 8, and the sequent control is finished. Moreover, if a positive judgment is made in the step S47 of FIG. 8, setting of a special injection quantity is performed and the sequent control is finished in step S48.

Figure 12:
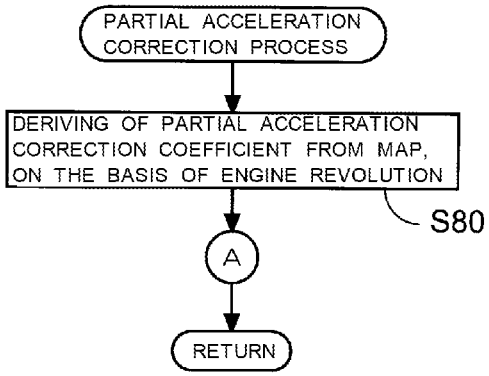
FIG. 12 is a flow chart showing procedures of the partial acceleration correction process.
Figure 13:
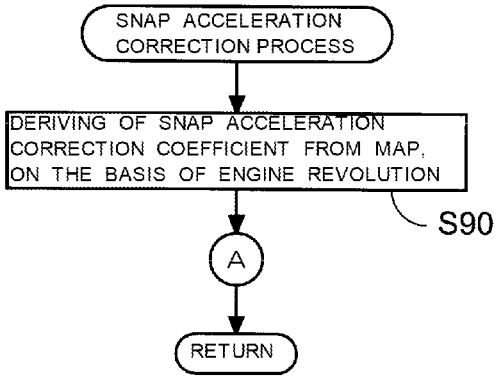
FIG. 13 is a flow chart showing procedures of the snap acceleration correction process.

FIG. 12 is a flow chart showing the procedures of the partial acceleration correction process. FIG. 13 is a flow chart showing the procedures of the snap acceleration correction process. Regarding the partial acceleration correction process, a partial acceleration correction coefficient is derived from a map (not shown) on the basis of the engine revolution speed in step S80 and the process progresses to the sub flow A shown in FIG. 9. Then, if the control of the sub flow A is finished, the process is returned to the main flow of FIG. 12 and the sequent control is finished. Moreover, regarding the snap acceleration correction process, a snap acceleration correction coefficient is also derived from a map (not shown) in step S90, the process progresses to the sub flow A shown in FIG. 9 and the sequent control is finished.

As shown in FIGS. 8, 12 and 13, the three types of the acceleration correction (ignition acceleration correction, partial acceleration correction, and snap acceleration correction) are merely different in the correction coefficient of the fuel injection quantity except that the four time injection control with the special correction amount is applied to the ignition acceleration correction.

As described above, according to the fuel injection control system of the present invention, not only the output of the throttle valve opening sensor but also the operation condition of the throttle grip are taken into consideration when the acceleration condition of the vehicle is detected according to the throttle valve opening and the increase amount correction of fuel is performed, so that even if the over-shoot and the under-shoot are produced in the real throttle valve opening relative to the target throttle valve opening in the throttle device to which the TBW system is applied, the correction of the fuel injection quantity is made possible according to the throttle grip operation by the rider, feeling of the engine is not provided so as to be unmatched with respect to the operation by the operator, and good fuel injection correction can be performed.

Concretely, in the case where the real opening of the throttle valve driven by the actuator over-shoots and under-shoots relative to the target opening, if the throttle is opened even when the real opening is lowered after the over-shoot, the acceleration correction is "maintained", so that the acceleration correction can be set so as not to be "attenuated" and "stopped" while the throttle grip is opened. Moreover, if the throttle grip is maintained at the fixed opening when the real opening rises after the under-shoot, the acceleration correction is "attenuated", so that the acceleration correction can be set so as not to be "maintained" while the throttle grip is stopped and the acceleration correction control can be performed according the throttle operation by the occupant.

Incidentally, the form of the vehicle, the structures and arrangement of the throttle valve opening sensor and throttle grip opening sensor, the forms of the three-dimensional map of the target throttle valve opening deriving means, the maintenance judgment value map, etc., the magnitude of the acceleration correction coefficients set in the three types of the acceleration correction control, the procedures of the attenuation process of the acceleration correction value, the setting of the special correction amount at the time of the ignition acceleration correction, etc. are not limited to the above-mentioned embodiments and various changes are made possible. For example, the acceleration correction control is not limited to the case where the three types of the ignition acceleration correction, the partial acceleration correction, and the snap acceleration correction are applied to, the two types of the acceleration correction may be applied, and the acceleration correction not less than four types of acceleration correction may be applied. The application of the fuel injection control system according to the present invention is not limited to the motorcycle and it can be applied to various vehicles such as saddle-ride type three-wheeled vehicles.

[Reference Signs List]

1 . . . Motorcycle (Vehicle),
14 . . . Engine,
26 . . . Throttle grip (Throttle operation means),
27 . . . Throttle grip opening sensor (Throttle operation condition detecting means),
28 . . . Throttle valve,
29 . . . Fuel injection valve,
30 . . . Throttle valve motor,
31 . . . Throttle valve opening sensor (Throttle valve opening detecting means),
32 . . . Vehicle speed sensor,
33 . . . Gear position sensor,
40 . . . ECU,
44 . . . Grip rotation speed change rate calculating means,
46 . . . Target throttle valve opening deriving means,
**46*a*** . . . Three-dimensional map,
47 . . . Throttle valve drive section,
48 . . . fuel injection amount controlling means,
60 . . . Transmission,
E . . . Target throttle valve opening,
F . . . Real throttle valve opening (Opening),
G . . . Throttle grip opening,
H . . . Maintenance judgment value

What is claimed is:

1. A fuel injection control system for a vehicle, which is provided with a throttle by wire (TBW) system detecting an operation condition of throttle operator and controls, via an actuator, a throttle valve provided in an intake system of an engine and adapted to detect an opening of the throttle valve and determine a fuel injection quantity, the fuel injection control system comprising:

a throttle operation condition detector that serves to detect the operation condition of the throttle operator;

a throttle valve opening detector that serves to detect the opening of the throttle valve; and a fuel injection quantity controller that serves to control fuel injection via a fuel injection valve provided at the engine;

wherein the fuel injection quantity controller determines an increased quantity correction value based upon an output of the throttle valve opening detector and the operation condition of the throttle operator, and wherein said fuel injection quantity controller is operable to detect an acceleration condition of the vehicle according to the output of the throttle valve opening and perform correction of an increase in quantity of fuel in response thereto;

wherein the fuel injection quantity controller is adapted to cause the increased quantity correction value to be brought to an attenuation condition in which the increased quantity correction value is gradually attenuated, or a stop condition in which the increased quantity correction value is made to be zero, when the acceleration condition of the vehicle is detected and the operation condition of the throttle operator is not in drive in an opening direction.

2. A fuel injection control system for a vehicle, which is provided with a throttle by wire (TBW) system detecting an operation condition of throttle operator and controls, via an actuator, a throttle valve provided in an intake system of an engine and adapted to detect an opening of the throttle valve and determine a fuel injection quantity, the fuel injection control system comprising:

a throttle operation condition detector that serves to detect the operation condition of the throttle operator;

a throttle valve opening detector that serves to detect the opening of the throttle valve; and a fuel injection quantity controller that serves to control fuel injection via a fuel injection valve provided at the engine;

wherein the fuel injection quantity controller determines an increased quantity correction value based upon an output of the throttle valve opening detector and the operation condition of the throttle operator, and wherein said fuel injection quantity controller is operable to detect an acceleration condition of the vehicle according to the output of the throttle valve opening and perform correction of an increase in quantity of fuel in response thereto;

wherein the fuel injection quantity controller is set so as to cause the increased quantity correction value to be brought to a maintenance condition in which the increased quantity correction value is maintained without change when the acceleration condition of the vehicle is not detected and the operation condition of the throttle operator is in drive in the opening direction.

3. A fuel injection control system for a vehicle, which is provided with a throttle by wire (TBW) system detecting an operation condition of throttle operator and controls, via an actuator, a throttle valve provided in an intake system of an engine and adapted to detect an opening of the throttle valve and determine a fuel injection quantity, the fuel injection control system comprising:

a throttle operation condition detector that serves to detect the operation condition of the throttle operator;

a throttle valve opening detector that serves to detect the opening of the throttle valve; and a fuel injection quantity controller that serves to control fuel injection via a fuel injection valve provided at the engine;

wherein the fuel injection quantity controller determines an increased quantity correction value based upon an output of the throttle valve opening detector and the operation condition of the throttle operator, and wherein said fuel injection quantity controller is operable to detect an acceleration condition of the vehicle according to the output of the throttle valve opening and perform correction of an increase in quantity of fuel in response thereto;

wherein: the fuel injection quantity controller is set so as to derive a target throttle valve opening of the throttle valve based upon a revolution number of the engine and a gear position of a transmission;

compare the target throttle valve opening to a fixed maintenance judgment value when the acceleration condition of the vehicle is detected and the operation condition of the throttle operator is in drive in the opening direction; and bring a renewal process of the increased quantity correction value corresponding to an output of the throttle valve opening detector to a continuation condition in which the renewal process is continued, if the target throttle valve opening is smaller than the maintenance judgment value.

4. The fuel injection control system according to claim 3, wherein if the target throttle valve opening is not less than the maintenance judgment value, the increased quantity correction value corresponding to the output of the throttle valve opening detector is set so as to be brought to a maintenance condition in which the increased quantity correction value is maintained without change.

5. The fuel injection control system according to claim 1, wherein the fuel injection quantity controller:

judges the operation condition of the throttle operator based upon an opening change amount of the throttle operator;

judges that the operation of the throttle operator is in the opening direction when the opening change amount is less than a fixed opening side threshold value;

judges that the operation condition of the throttle operator is in stop when the opening change amount is less than the fixed opening side threshold value and is not less than a fixed closing side threshold value;

judges that the operation condition of the throttle operator is in a closing direction or is fully closed when the opening change amount is less than the fixed closing side threshold value; and brings the increased quantity correction value to an attenuation condition in which the increased quantity correction value is gradually decreased when the operation condition of the throttle operator is in stop and, on the other hand, brings the increased quantity correction value to a stop condition in which the increased quantity correction amount is made to zero, if it is judged that the operation condition of the throttle operator is in the closing direction or is fully closed.

6. The fuel injection control system according to claim 5, wherein the increased quantity correction amount is decreased by using a first stage attenuation degree in the attenuation condition and, if the increased quantity correction amount becomes a fixed value, the increased quantity correction amount is decreased until it becomes zero, by using a second stage attenuation degree.

7. The fuel injection control system according to claim 2, wherein if a throttle valve opening change amount that is detected by the throttle valve opening detector is not less than a fixed value, the fuel injection quantity controller brings the renewal process of the increased quantity correction value corresponding to the output of the throttle valve opening detector to a continuation condition in which the renewal process is continued.

8. The fuel injection control system according to claim 4, wherein the maintenance judgment value is derived from a data map previously defined according to a gear stage number of the transmission and the revolution number of the engine.

9. The fuel injection control system according to claim 3, wherein if a throttle valve opening change amount that is detected by the throttle valve opening detector is not less than a fixed value, the fuel injection quantity controller brings the renewal process of the increased quantity correction value corresponding to the output of the throttle valve opening detector to a continuation condition in which the renewal process is continued.

10. A fuel injection control system for a vehicle, which is provided with a throttle by wire system detecting an operation condition of throttle operator and controls, via an actuator, a throttle valve provided in an intake system of an engine and adapted to detect an opening of the throttle valve and determine a fuel injection quantity, the fuel injection control system comprising:

a throttle operation condition detector that serves to detect the operation condition of the throttle operator;

a throttle valve opening detector that serves to detect the opening of the throttle valve; and a fuel injection quantity controller that serves to control fuel injection via a fuel injection valve provided at the engine;

wherein the fuel injection quantity controller determines an increased quantity correction value and injects an increased quantity of fuel into said engine based upon an output of the throttle valve opening detector and the operation condition of the throttle operator to prevent an operation of the engine from being unmatched to a throttle operator condition;

wherein the fuel injection quantity controller is adapted to cause the increased quantity correction value to be brought to an attenuation condition in which the increased quantity correction value is gradually attenuated, or a stop condition in which the increased quantity correction value is made to be zero, when the acceleration condition of the vehicle is detected and the operation condition of the throttle operator is not in drive in an opening direction.

11. A fuel injection control system for a vehicle, which is provided with a throttle by wire system detecting an operation condition of throttle operator and controls, via an actuator, a throttle valve provided in an intake system of an engine and adapted to detect an opening of the throttle valve and determine a fuel injection quantity, the fuel injection control system comprising:

a throttle operation condition detector that serves to detect the operation condition of the throttle operator;

a throttle valve opening detector that serves to detect the opening of the throttle valve; and a fuel injection quantity controller that serves to control fuel injection via a fuel injection valve provided at the engine;

wherein the fuel injection quantity controller determines an increased quantity correction value and injects an increased quantity of fuel into said engine based upon an output of the throttle valve opening detector and the operation condition of the throttle operator to prevent an operation of the engine from being unmatched to a throttle operator condition;

wherein the fuel injection quantity controller is set so as to cause the increased quantity correction value to be brought to a maintenance condition in which the increased quantity correction value is maintained without change when the acceleration condition of the vehicle is not detected and the operation condition of the throttle operator is in drive in the opening direction.

12. A fuel injection control system for a vehicle, which is provided with a throttle by wire system detecting an operation condition of throttle operator and controls, via an actuator, a throttle valve provided in an intake system of an engine and adapted to detect an opening of the throttle valve and determine a fuel injection quantity, the fuel injection control system comprising:

a throttle operation condition detector that serves to detect the operation condition of the throttle operator;

a throttle valve opening detector that serves to detect the opening of the throttle valve; and a fuel injection quantity controller that serves to control fuel injection via a fuel injection valve provided at the engine;

wherein the fuel injection quantity controller determines an increased quantity correction value and injects an increased quantity of fuel into said engine based upon an output of the throttle valve opening detector and the operation condition of the throttle operator to prevent an operation of the engine from being unmatched to a throttle operator condition;

wherein: the fuel injection quantity controller is set so as to derive a target throttle valve opening of the throttle valve based upon a revolution number of the engine and a gear position of a transmission;

compare the target throttle valve opening to a fixed maintenance judgment value when the acceleration condition of the vehicle is detected and the operation condition of the throttle operator is in drive in the opening direction; and bring a renewal process of the increased quantity correction value corresponding to an output of the throttle valve opening detector to a continuation condition in which the renewal process is continued, if the target throttle valve opening is smaller than the maintenance judgment value.

13. The fuel injection control system according to claim 12, wherein if the target throttle valve opening is not less than the maintenance judgment value, the increased quantity correction value corresponding to the output of the throttle valve opening detector is set so as to be brought to a maintenance condition in which the increased quantity correction value is maintained without change.

14. The fuel injection control system according to claim 10, wherein the fuel injection quantity controller:

judges the operation condition of the throttle operator based upon an opening change amount of the throttle operator;

judges that the operation of the throttle operator is in the opening direction when the opening change amount is less than a fixed opening side threshold value;

judges that the operation condition of the throttle operator is in stop when the opening change amount is less than the fixed opening side threshold value and is not less than a fixed closing side threshold value;

judges that the operation condition of the throttle operator is in a closing direction or is fully closed when the opening change amount is less than the fixed closing side threshold value; and brings the increased quantity correction value to an attenuation condition in which the increased quantity correction value is gradually decreased when the operation condition of the throttle operator is in stop and, on the other hand, brings the increased quantity correction value to a stop condition in which the increased quantity correction amount is made to zero, if it is judged that the operation condition of the throttle operator is in the closing direction or is fully closed.

15. The fuel injection control system according to claim 14, wherein the increased quantity correction amount is decreased by using a first stage attenuation degree in the attenuation condition and, if the increased quantity correction amount becomes a fixed value, the increased quantity correction amount is decreased until it becomes zero, by using a second stage attenuation degree.

16. The fuel injection control system according to claim 11, wherein if a throttle valve opening change amount that is detected by the throttle valve opening detector is not less than a fixed value, the fuel injection quantity controller brings the renewal process of the increased quantity correction value corresponding to the output of the throttle valve opening detector to a continuation condition in which the renewal process is continued.

17. The fuel injection control system according to claim 13, wherein the maintenance judgment value is derived from a data map previously defined according to a gear stage number of the transmission and the revolution number of the engine.

18. The fuel injection control system according to claim 12, wherein if a throttle valve opening change amount that is detected by the throttle valve opening detector is not less than a fixed value, the fuel injection quantity controller brings the renewal process of the increased quantity correction value corresponding to the output of the throttle valve opening detector to a continuation condition in which the renewal process is continued.

* * * * *